US008858240B2

(12) United States Patent
Wu et al.

(10) Patent No.: US 8,858,240 B2
(45) Date of Patent: Oct. 14, 2014

(54) CABLE ASSEMBLY

(71) Applicant: Hon Hai Precision Industry Co., Ltd., New Taipei (TW)

(72) Inventors: Jerry Wu, Irvine, CA (US); Jun Chen, Kunshan (CN); Fan-Bo Meng, Kunshan (CN)

(73) Assignee: Hon Hai Precision Industry Co. Ltd., New Taipei (TW)

( * ) Notice: Subject to any disclaimer, the term of this patent is extended or adjusted under 35 U.S.C. 154(b) by 0 days.

(21) Appl. No.: 13/943,757

(22) Filed: Jul. 16, 2013

(65) Prior Publication Data

US 2014/0017944 A1 Jan. 16, 2014

(30) Foreign Application Priority Data

Jul. 16, 2012 (CN) ..... 2012 1 0243355

(51) Int. Cl.
*H01R 12/00* (2006.01)
*H01R 13/6585* (2011.01)
*H01R 13/66* (2006.01)

(52) U.S. Cl.
CPC ..... *H01R 13/6658* (2013.01); *H01R 13/6585* (2013.01)
USPC ..... 439/76.1; 439/607.45

(58) Field of Classification Search
USPC ..... 439/76.1, 607.41, 607.45, 607.46
See application file for complete search history.

(56) References Cited

U.S. PATENT DOCUMENTS 7,134,914 B1 * 11/2006 Wu ..... 439/607.41
7,147,502 B1 * 12/2006 Wu ..... 439/352
7,238,049 B1 7/2007 Wu

FOREIGN PATENT DOCUMENTS

CN 201097418 8/2008
CN 201966402 9/2011

* cited by examiner

*Primary Examiner* — Khiem Nguyen
(74) *Attorney, Agent, or Firm* — Wei Te Chung; Ming Chieh Chang

(57) ABSTRACT

A cable assembly comprises: a metallic housing; a PCB received into the metallic housing. The PCB defines a plurality of grounding conductive pads and a plurality of pairs of signal conductive pads formed on a rear end thereof. Each pair of signal conductive pads are intervened between two grounding conductive pads. And a cable having a plurality of wires are electrically connected with the PCB. Wherein at least one wire of the plurality of wires comprises a pair of differential signal conductors electrically connected to a corresponding pair of signal conductive pads, and a grounding conductor electrically connected to two grounding conductive pads located at two sides of the pair of signal conductive pads.

19 Claims, 8 Drawing Sheets

CABLE ASSEMBLY

BACKGROUND OF THE INVENTION

1. Field of the Invention

The present invention generally relates to a cable assembly, and more particularly to a cable assembly used for high-speed signal transmission. The application relates to a copending application filed on Jul. 16, 2013, titled with "CABLE CONNECTOR" having the same inventors and the same assignee with the instant application.

2. Description of Related Art

U.S. Pat. No. 7,238,049B1 issued to Wu on Jul. 3, 2007 discloses an electronic device interconnection system. The electronic device interconnection system comprises: a plug connector comprising: a metallic housing defining a roomage; a printed circuit board received in the roomage; at least one cable electrically connected with the printed circuit board; and a receptacle connector mating with the plug connector, comprising: an insulated housing defining a receiving passage; a plurality of terminals received in the insulated housing; a metal shell defining a body portion with a hollow to receive the insulated housing. In the existing technology, the cable usually have a plurality of sets of conductive wires. Each set of conductive wire usually comprises two differential signal conductors and a grounding conductor formed therein. And the PCB defines several groups of differential signal conductive pads electrically connected with the plurality of differential signal conductors, and a plurality of grounding conductive pads electrically connected with the plurality of grounding conductors. Each of grounding conductive pad is located adjacent to two signal conductive pads. Thus, a grounding conductor and two signal conductors of a set of wire are respectively soldered to two signal conductive pads and a grounding pad adjacent to the two signal conductive pads.

A cable of the above said plug connector is used for transmitting differential mode signals. However, in actual system, a differential-mode signal may be transformed to be a common-mode signal due to several factors, such as impedance discontinuities, interference between two adjacent signal transmitting and noise interference of power supply. According to above said arrangement of the conductive pads of the above said PCB, a proportion of differential-mode signals transformed to be common-mode signals is larger. As a result, quality of signal transmission of the plug connector will be affected by the signal transmission from differential-mode signals converted to common-mode signals.

Hence, an improved cable assembly is highly desired to overcome the disadvantages of the related art.

SUMMARY OF THE INVENTION

Accordingly, an object of the present invention is to provide a cable assembly with high quality of differential signal transmission.

In order to achieve the object set forth, a cable assembly comprises: a metallic housing; a PCB received into the metallic housing. The PCB defines a plurality of grounding conductive pads and a plurality of pairs of signal conductive pads formed on a rear end thereof Each pair of signal conductive pads are intervened between two grounding conductive pads. And a cable having a plurality of wires are electrically connected with the PCB. Wherein at least one wire of the plurality of wires comprises a pair of differential signal conductors electrically connected to a corresponding pair of signal conductive pads, and a grounding conductor electrically connected to two grounding conductive pads located at two sides of the pair of signal conductive pads.

Other objects, advantages and novel features of the invention will become more apparent from the following detailed description when taken in conjunction with the accompanying drawings.

DETAILED DESCRIPTION OF THE INVENTION

Figure 1:
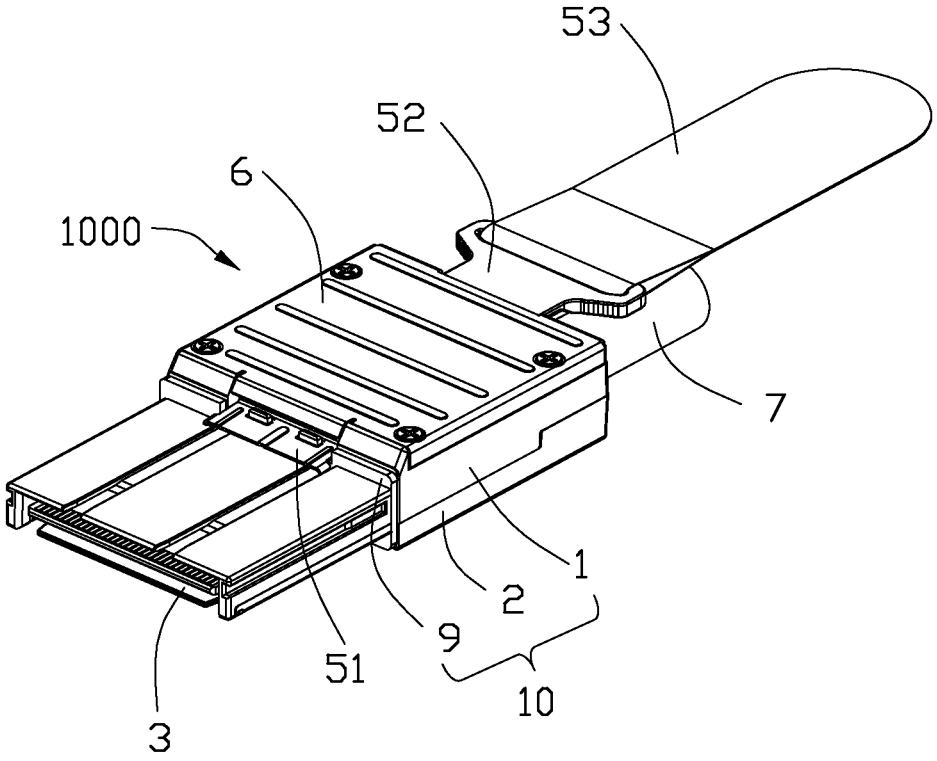
FIG. 1 is an assembled, perspective view of a cable assembly in accordance with the present invention.

Reference will now be made in detail to the preferred embodiment of the present invention.

Referring to FIGS. 1 to 8, a cable assembly 1000 in according to the present invention, comprises a metallic housing 10, a printed circuit board (PCB) 3 accommodated in the metallic housing 10, a cable 7 electrically connected with the PCB 3, a spacer 4 assembled to the cable 7, an insulative protective member 8 formed on a connection between the PCB 3 and the cable 7, a locking mechanism 5 assembled to an exterior surface of the metallic housing 10 and a cover 6 assembled to the metallic housing 10. The metallic housing 10 comprises a first shielding piece 1, a second shielding piece 2 assembled with each other along a vertical direction. The cable assembly 1000 further comprises a gasket 9 assembled to an out surface of a mating portion of the metallic housing 10.

Figure 2:
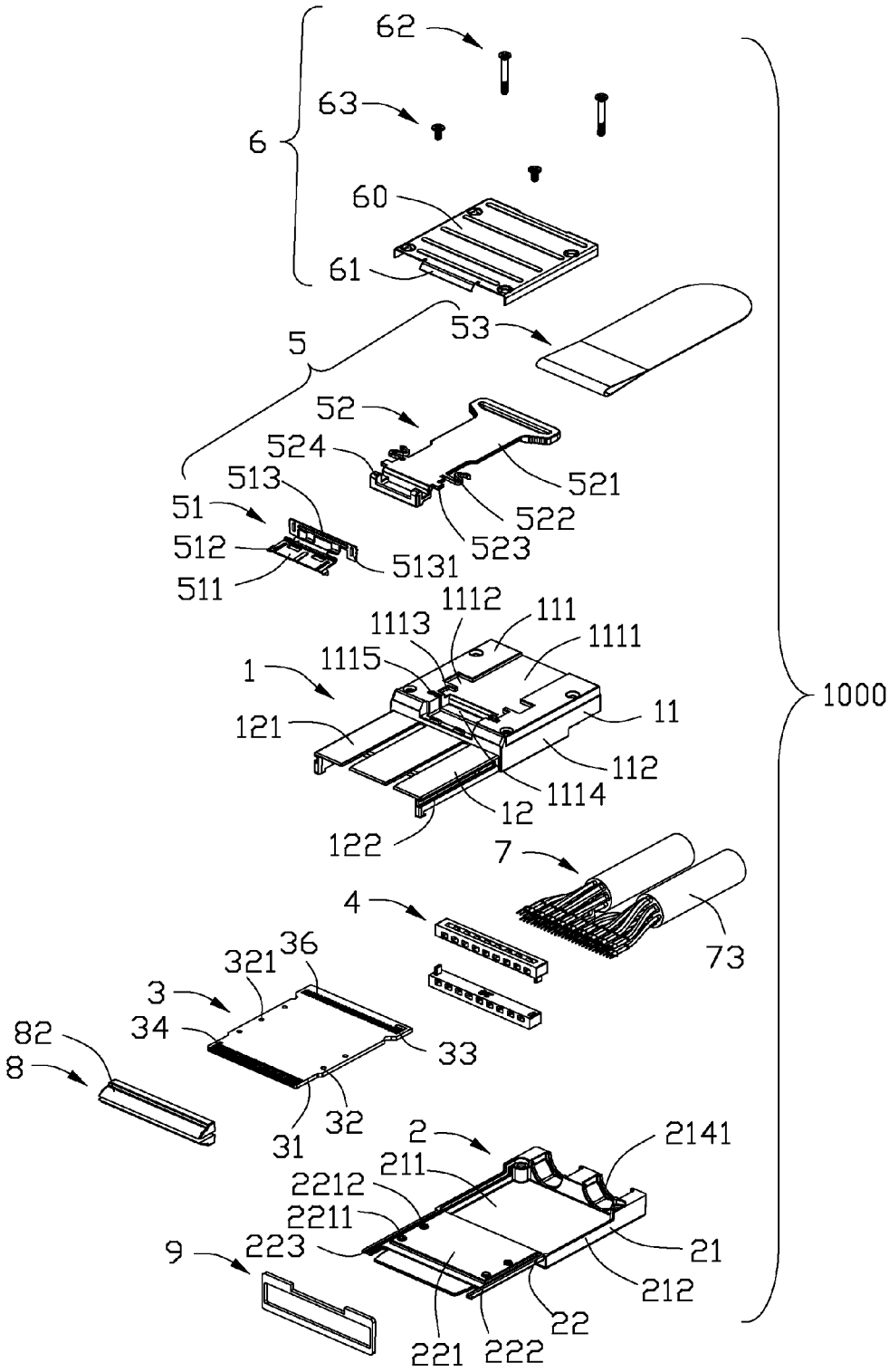
FIG. 2 is an exploded, perspective view of the cable assembly shown in FIG. 1.
Figure 3:
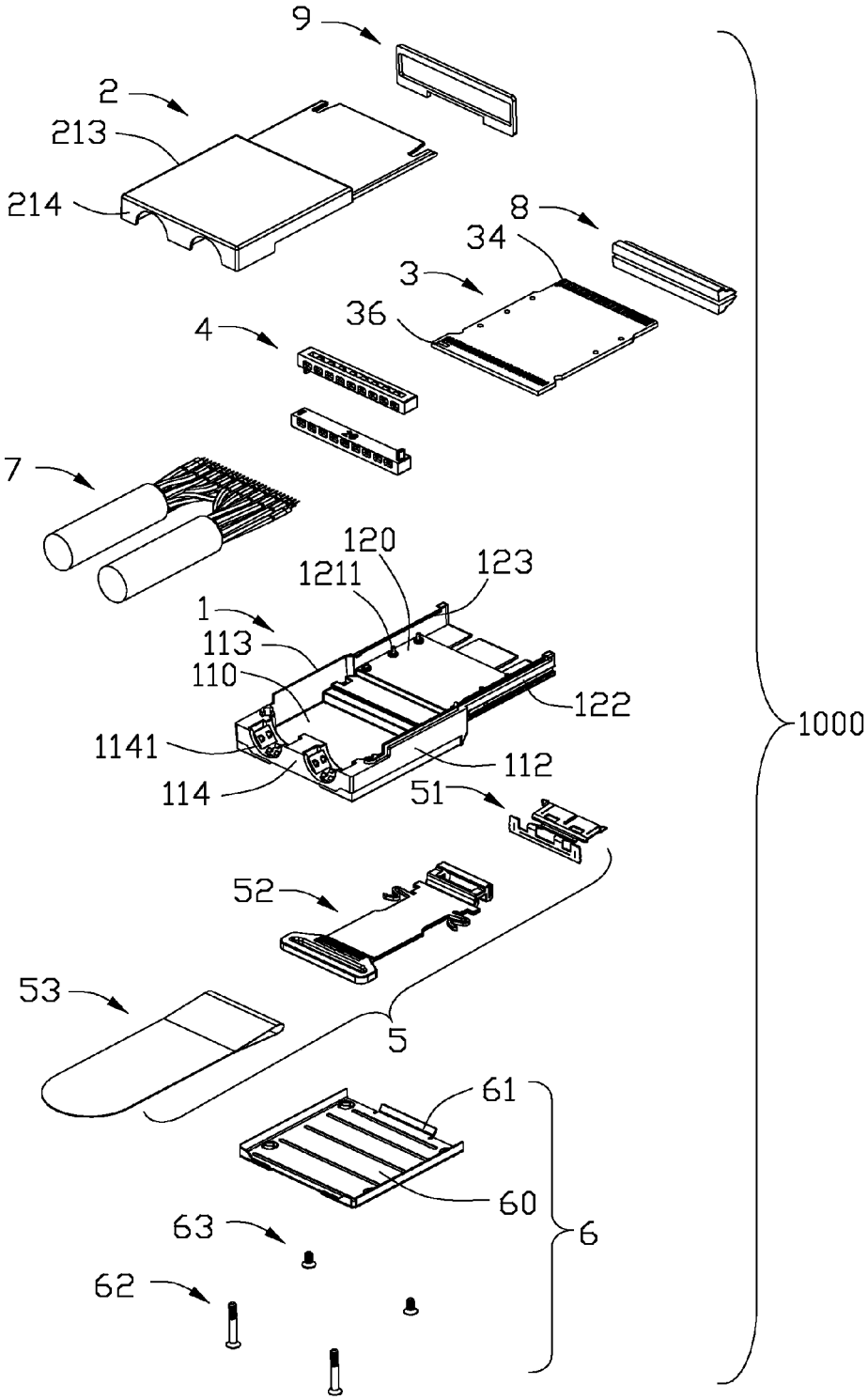
FIG. 3 is a view similar to FIG. 2, but viewed from another aspect.
Figure 4:
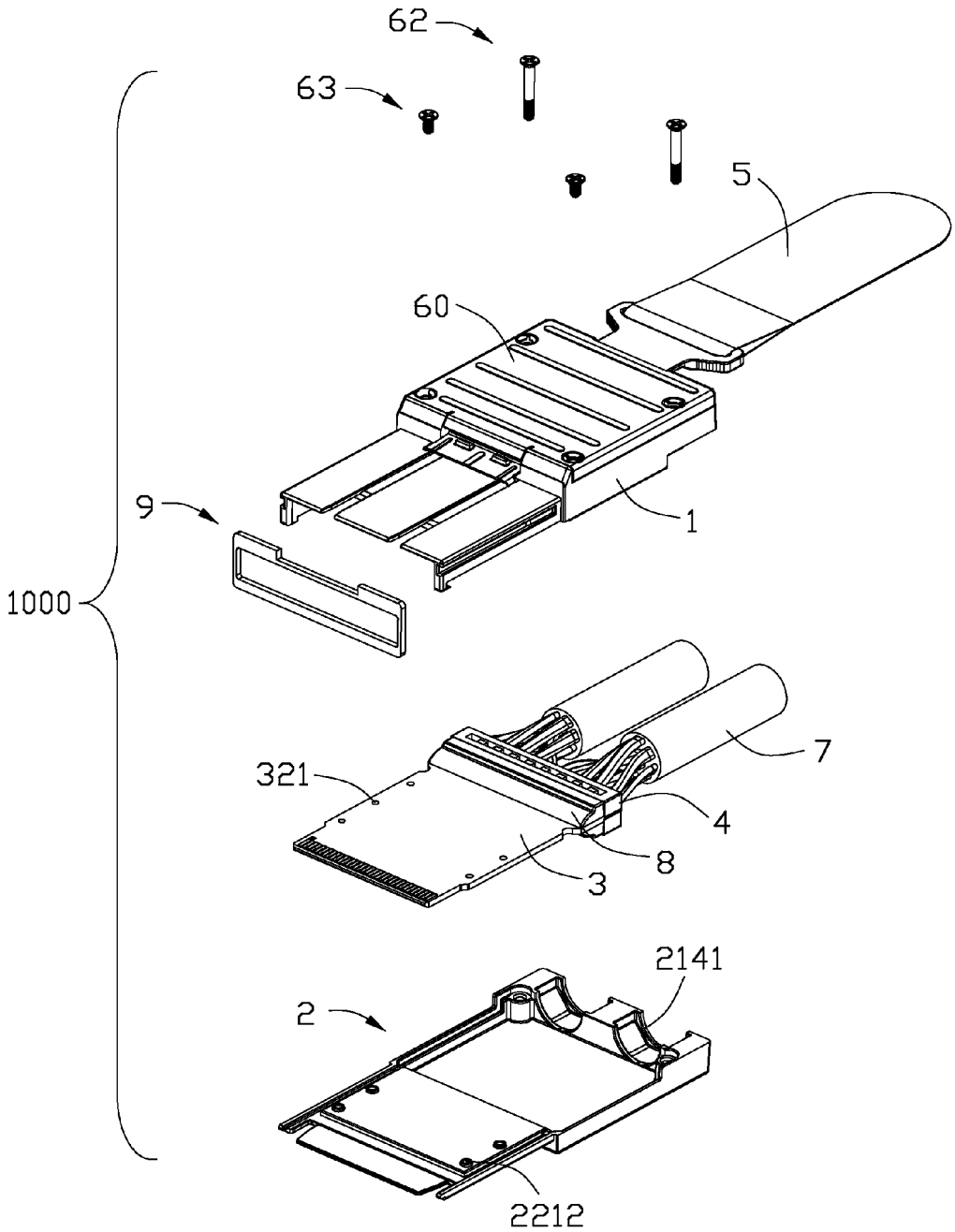
FIG. 4 is a partially assembled view of the cable assembly shown in FIG. 1.
Figure 5:
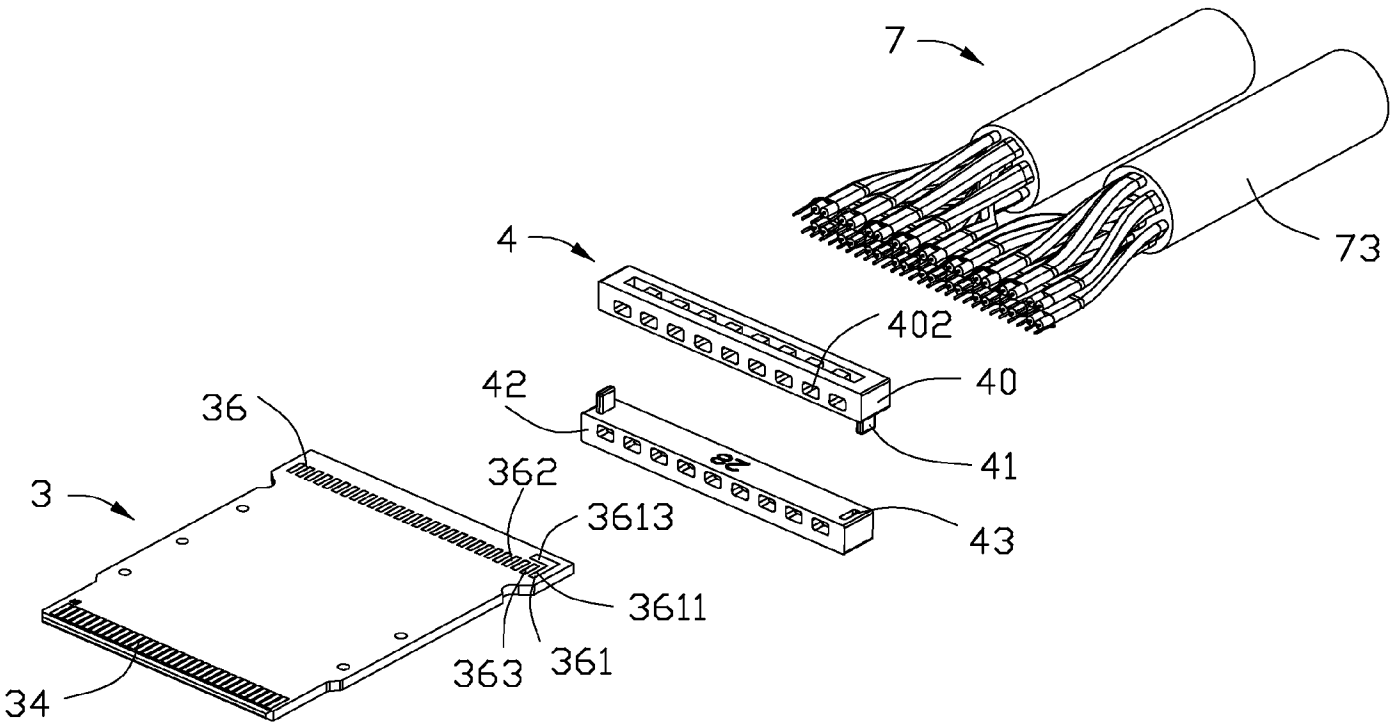
FIG. 5 is an exploded, perspective view of a cable, a PCB and a spacer of the cable assembly shown in FIG. 2.
Figure 6:
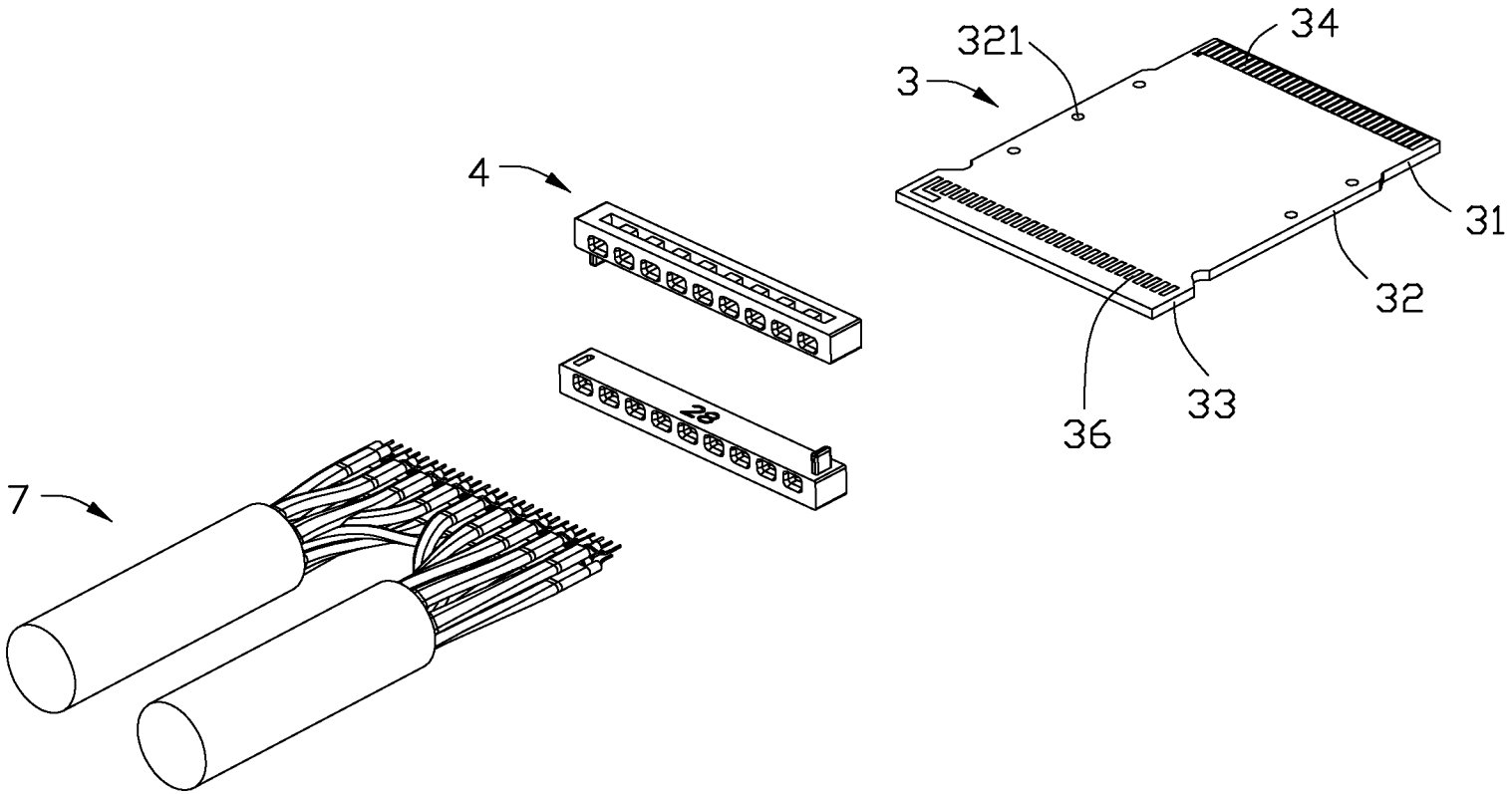
FIG. 6 is a view similar to FIG. 5, but viewed from another aspect.
Figure 7:
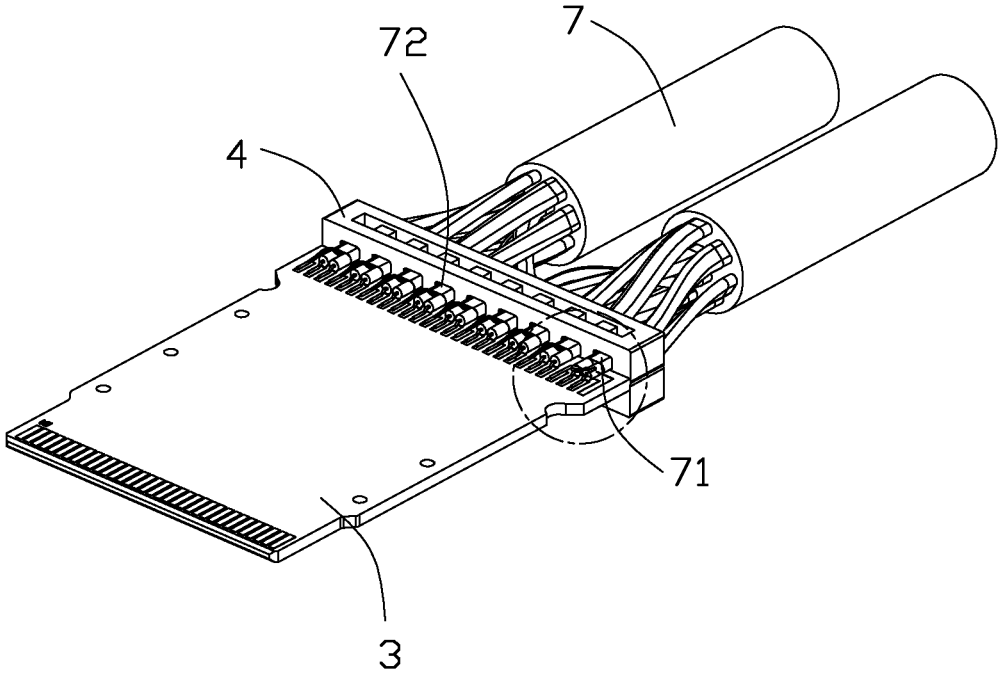
FIG. 7 is an assembled view of the cable, the PCB and the spacer of the cable assembly.
Figure 8:
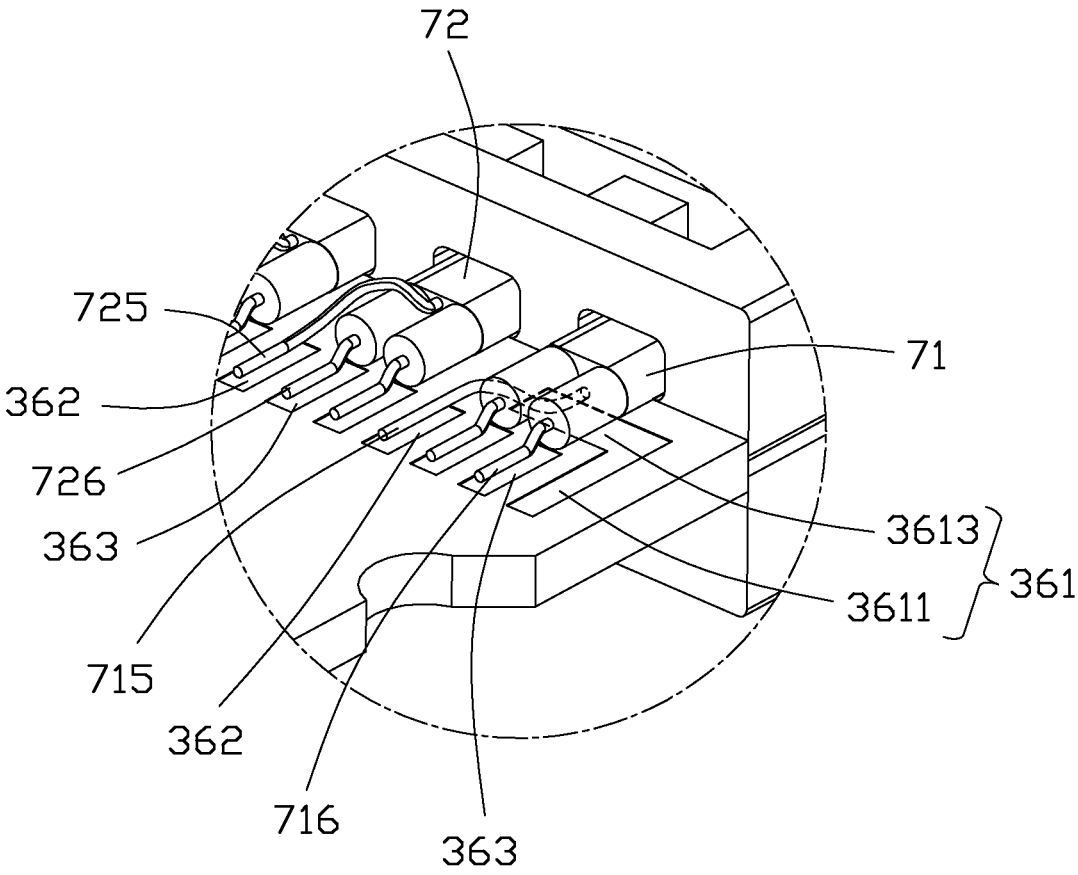
FIG. 8 is an enlarged view of a circle shown in FIG. 7.

Referring to FIGS. 2 to 3, the first shielding piece 1 comprises a first base section 11 and a first mating portion 12 extending forwardly from a front end of the first base section 11. The first base section 11 comprises an upper wall 111, a pair of side walls 112, 113, and a rear wall 114. A receiving cavity 110 is formed by the four walls 111, 112, 113, 114. The rear wall 114 defines two semicircle notches 141 arranged in a row along a transverse direction. The first mating portion 12 comprises an upper wall 121 and a pair of side walls 122, 123. A mating port 120 is formed by the above said upper wall 121, a pair of side walls 122, 123 and communicated with the receiving cavity 110. The mating port 120 is disposed in front of the receiving cavity 110. Two pairs of positioning posts 1211 are arranged at the two sides of a bottom surface of the upper wall 121. The upper wall 111 defines a first channel 1111 formed on a top surface thereof and a second channel 1114 located in front of the first channel 1111 and communicated with the first channel 1111. And, the second channel 1114 is located on a lower level than the first channel 1111. A pair of the first grooves 1112 are formed on a top surface of the upper wall 111, and located at two sides of the first channel and communicated with the first channel 1111. A pair of second grooves 1113 are located in front of the first grooves 1112 and communicated with the first channel 1111. A pair of slits 1115 are formed on the top surface of the upper wall 111 and communicated with the second channel 1114.

The second shielding piece 2 comprises a second base section 21 and a second mating portion 22 extending forwardly from the front edge of the second base section 21. The second base section 21 comprises a bottom wall 211, a pair of side walls 212, 213, and a rear wall 214 extending upwardly from the rear edge of the bottom wall 211. Two semicircle notches 2141 are defined on the rear wall 214 and arranged in a row along a transverse direction. The second mating portion 22 defines a bottom wall 221, and a pair flanges 222, 223 formed on two sides of the bottom wall 221. The bottom wall 221 of the second mating portion 22 defines two pairs of supporting posts 2211 formed on two lateral sides thereof Each of supporting post 2211 defines a hole 2212 for receiving positioning posts 1211.

Referring to FIGS. 2 to 8, the PCB 3 comprises a middle section 32, a narrow front section 31 and a wider rear section 33. The PCB 3 defines a plurality of conductive pads formed on top and bottom surfaces thereof. The plurality of conductive pads comprises a group of first conductive pads 34 located in the front section 31 to form a mating interface and another group of second conductive pads 36 formed on a rear section 33 for terminating to the cable 7. A distance between two adjacent first conductive pads 34 is narrower than a distance between two adjacent second conductive pads 36. The middle section 32 defines a pair of through holes 321 formed at two sides thereof. The second conductive pads 36 comprise a plurality of grounding conductive pads 361, 362 and several pairs of differential signal conductive pads 363 arranged along a transversal direction. There is at least one grounding pad 361, 362 is located at each lateral side of each pair of the signal conductive pads 363. The grounding conductive pads 361, 362 comprises at least one first grounding conductive pads 361 and a plurality of second grounding conductive pads 362. The first grounding conductive pad 361 is structured in a L-shape. It should be noted that the first grounding conductive pad 361 is located at a lateral side of the all second conductive pads 36 and comprises a main portion 3611 paralleled with a signal conductive pad 363 and a transverse portion 3613 perpendicular to the main portion 3611 and located in back of a pair of signal conductive pads 363.

Referring to FIGS. 2 to 8, the cable 7 comprises a plurality of sets of wires and an insulator 73 shielding the plurality of sets of wires. The plurality of sets of wires comprises at least one set of first wire 71 and a plurality of sets of second wires 72. Each set of first wire 71 comprises a grounding conductor 715 and a pair of differential signal conductors 716. Each set of second wire 72 also comprises a grounding conductor 725 and a pair of differential signal conductors 726. Each set of second wire 72 has a similar structure to each set of first wire 71 except the bending direction of the grounding conductor 725. It should be noted that the grounding conductor 725 of a set of second wire 72 extends upwardly firstly, and then extends downwardly to electrically connected to a second grounding conductive pad 362. However, the grounding conductor 715 of a set of first wire 71 is attached to a top surface of the PCB 3. The grounding conductor 715 has a portion electrically connected to the transverse portion 3613 of the first grounding conductive pad 361 and a free end electrically to a second grounding conductive pad 362. The pair of signal conductors 716 of one set of first wire 71 are soldered to two signal conductive pads 363. The grounding conductors 715 of one set of first wire 71 is both electrically to the first and second grounding conductive pads 361, 362. A plurality of pairs of signal conductors 716, 726 are soldered to the plurality of corresponding pairs of signal conductive pads 363.

Referring to FIGS. 2 to 3, a locking mechanism 5 is assembled to an exterior surface of the metallic housing 10. The locking mechanism 5 comprises a locking member 51, a actuating member 52 and a tape 53 connected to the actuating member 52. The actuating member 52 comprises a body portion 521 received into the first channel 1111 and a pair of the elastic members 522 formed at two sides of the body portion 521 and received into the first grooves 1112, a pair of stop portions 523 located in front of the elastic members 522 and side of the body portion 521 and received into the second grooves 1113, and an actuating portion 524 located in a front end of the body portion 521 and located in the second channel 1114. The locking member 51 comprises a locking portion 511 located above the first mating portion 12, an engaging portion 513 engaged with the first base section 11 and a N-shaped connecting portion 512. The engaging portion 513 defines two sides portions 5131 respectively received into the two slits 1115 to achieve an engagement between the locking member 51 and the housing 10.

Referring to FIGS. 2 to 7, the spacer 4 comprises two wire managements 42 with the same structure assembled with each other along a vertical direction. Each of the wire management 42 comprise a holding portion 40 with a plurality of slots 402 for a plurality of sets of first and second wires 71, 72 passing through, and a protruding piece 41 and a recess 43 formed on a bottom surface of the holding portion 40. The insulative protective member 8 comprises two protective pieces 82 respectively formed on a connection between the cable 7 and the PCB 3, and located in front of the spacer 4.

Referring to FIGS. 1 to 8, the cable assembly 1000 is assembled together through following steps. Firstly, the plurality of sets of first and second wires 71, 72 are arranged into two rows and respectively passed through the receiving slots 402. Secondly, at least one grounding conductor 715 and a pair of signal conductors 716 are respectively soldered to the grounding conductive pads 361, 362 and a pair of signal conductive pads 363. The plurality of the grounding conductors 725 and the signal conductors 726 are respectively soldered to the grounding conductive pads 362 and the plurality of pairs of signal conductive pads 363. Thirdly, two protective piece 82 are respectively molded around a connection area between the grounding and signal conductors 715, 725, 716, 726 and the grounding and signal conductive pads 361, 362, 363. Then, the cable 7, the protective member 8, the PCB 3, the spacer 4 are together assembled to the first shielding piece 1. The cable 7 is pass through the semicircle notch 1141 and extended into the receiving cavity 110. The PCB 3 is assembled to the first shielding piece 1 and supported by two pairs of the positioning posts 1211. The positioning posts 1211 pass through the through hole 321 of the PCB 3. The mating interface of the PCB 3 extends to the mating port 120 and the rear section 33 of the PCB 3 is located in the receiving cavity 110. Then, the second shielding piece 2 is assembled to the first shielding piece 1. The PCB 3 is supported by the supporting member 2211 of the second shielding piece 2. As a result, the positioning posts 1211 of the first shielding piece 1 pass through the through hole 321 and then enter into the hole 2212 of the supporting member 2211. Then, the gasket 9 is assembled to an outer surface of the mating portion of the housing 10. At last, the locking mechanism 5 is assembled to the first shielding piece 1, the cover 6 is assembled to the first shielding piece for shielding the locking mechanism 5. A pair of the first screws 62 and second screws 63 are assembled to the first shielding piece 1 and the second shielding piece 2 for interconnecting the first shielding piece 1, the second shielding piece 2 and the cover 6. After the above assembling steps, the entire process of assembling of the cable assembly 1000 is finished.

As at least one first grounding conductive pad 361 is defined on a lateral side of the plurality of second conductive pads 36, thus, the grounding conductor 715 of a set of first wire 71 is both electrically connected to the first and second grounding conductive pads 361, 362. Obviously, a pair of differential signal conductors 716 of a set of first wire 71 is achieved to a balance of signal symmetry. As a result, a differential-mode signal of the plurality of pairs of differential signal conductors will not be transformed to a common-mode signal. Thus, a quality of differential signal transmission of the cable assembly 1000 will be improved.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A cable assembly comprising:

a metallic housing;

a PCB received into the metallic housing, the PCB defining a plurality of grounding conductive pads and a plurality of pairs of signal conductive pads formed on a rear end thereof, each pair of signal conductive pads intervened between two grounding conductive pads; and a cable having a plurality of wires electrically connected with the PCB; wherein at least one wire of the plurality of wires comprises a pair of differential signal conductors electrically connected to a corresponding pair of signal conductive pads, and a grounding conductor electrically connected to two grounding conductive pads located at two sides of the pair of signal conductive pads.

2. The cable assembly as claimed in claim 1, wherein two grounding conductive pads comprises a first grounding conductive pad having a main portion paralleled with a signal conductive pad of the pair of signal conductive pads and a transverse portion perpendicular to the main portion and located in back of the pair of signal conductive pads.

3. The cable assembly as claimed in claim 2, wherein the grounding conductor of at least one wire is electrically connected to the transverse portion of the first grounding conductive pad.

4. The cable assembly as claimed in claim 3, wherein the first grounding pad is located on a lateral side of the plurality of grounding and signal conductive pads.

5. The cable assembly as claimed in claim 1, wherein the metallic housing comprises a first shielding piece and a second shielding piece assembled with each other along a vertical direction.

6. The cable assembly as claimed in claim 1, wherein the cable assembly further comprises a locking mechanism assembled to an exterior surface of the metallic housing.

7. The cable assembly as claimed in claim 1, wherein the plurality of wires are arranged into two rows and respectively electrically connected to top and bottom surfaces of the PCB.

8. The cable assembly as claimed in claim 7, wherein cable assembly further comprises two wire managements respectively assembled to two rows of wires.

9. The cable assembly as claimed in claim 8, wherein the cable assembly further comprises two protective pieces molded around a connection between the wires and the PCB.

10. A cable assembly comprising:

a housing;

a PCB received into the housing, the PCB defining a plurality of grounding conductive pads and a plurality of pairs of signal conductive pads formed on a top surface thereof, each pair of signal conductive pads sandwiched between two grounding conductive pads; and a cable having a plurality of wires electrically connected to the signal and grounding conductive pads of the PCB; wherein one wire of the plurality of wires comprises a pair of differential signal conductors electrically connected to a corresponding pair of signal conductive pads, and a grounding conductor electrically connected to two grounding conductive pads located at two sides of the pair of signal conductive pads.

11. The cable assembly as claimed in claim 10, wherein one of the two grounding conductive pad is structured in a L-shape and has a portion located in back of the pair of signal conductive pads.

12. The cable assembly as claimed in claim 10, wherein the cable assembly further comprises a locking mechanism assembled to an exterior surface of the metallic housing.

13. The cable assembly as claimed in claim 11, wherein the L-shaped grounding pad is located on a lateral side of the plurality of grounding and signal conductive pads.

14. A cable connector assembly comprising:

a printed circuit board;

a plurality of conductive pads formed along an edge region on said printed circuit board and arranged in one row along a transverse direction, said conductive pads being categorized with differential pairs of signal pads and grounding pads alternate arranged with each other along said transverse direction;

a cable extending along a front-to-back direction perpendicular to said transverse direction, and including a plurality of sub-cables each equipped with a differential pairs of signal conductors and a grounding conductor; wherein the grounding conductor of a selected one of said sub-cables simultaneously electrically and mechanically connected to both selected two grounding pads intimately located, in said transverse direction, by two opposite sides of a commonly neighboring differential pair of signal pads where the corresponding differential pair of signal conductors of said selected one of the sub-cables are mechanically and electrically connected, respectively.

15. The cable connector assembly as claimed in claim 14, wherein said selected two grounding pads are discrete from each other.

16. The cable connector assembly as claimed in claim 15, wherein one of said selected two grounding pads defines an L-shaped configuration having one end region extending toward and under the selected one of the sub-cables and essentially located between said commonly neighboring differential pair of signal pads.

17. The cable connector assembly as claimed in claim 16, wherein the grounding conductor of said selected one of said sub-cables is connected to said selected two grounding pads at two different positions.

18. The cable connector assembly as claimed in claim 17, wherein the grounding conductor of said selected one of said sub-cables is first connected to said one of the selected two grounding pads with the L-shaped configuration, and successively to the other around a free end thereof.

19. The cable connector assembly as claimed 14, wherein in a cross-sectional view, the grounding conductor is located below the corresponding differential pair of signal conductors of the selected one of the sub-cables in a vertical direction perpendicular to both said transverse direction and said front-to-back direction, while the grounding conductor of others of the sub-cables are located above the corresponding differential pairs of signal conductors of others of the sub-cables.

* * * * *